US012405054B2

(12) United States Patent
Davidian

(10) Patent No.: US 12,405,054 B2
(45) Date of Patent: Sep. 2, 2025

(54) HEAT EXCHANGER AND SEPARATION APPARATUS COMPRISING A HEAT EXCHANGER

(71) Applicant: L'Air Liquide, Societe Anonyme pour l'Etude et l'Exploitation des Procedes Georges Claude, Paris (FR)

(72) Inventor: Benoit Davidian, Champigny-sur-Marne (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 265 days.

(21) Appl. No.: 18/094,168

(22) Filed: Jan. 6, 2023

(65) Prior Publication Data

US 2023/0221068 A1 Jul. 13, 2023

(30) Foreign Application Priority Data

Jan. 7, 2022 (FR) ..... 2200107

(51) Int. Cl.
*F25J 3/04* (2006.01)

(52) U.S. Cl.
CPC ..... *F25J 3/04218* (2013.01); *F25J 3/04412* (2013.01); *F25J 2290/40* (2013.01)

(58) Field of Classification Search
CPC .. F25J 3/04218; F25J 3/04412; F25J 3/04418; F25J 3/04; F25J 3/04206;
(Continued)

(56) References Cited

U.S. PATENT DOCUMENTS 2,840,994 A 7/1958 Lobo et al.
4,715,433 A * 12/1987 Schwarz ..... F28D 9/0068 165/913

(Continued)

FOREIGN PATENT DOCUMENTS

DE 10 2018 009780 6/2020
EP 1 338 856 8/2003

(Continued)

OTHER PUBLICATIONS

Hands, B.A. (edited by), "Cryogenic Engineering," Department of Engineering Science, University of Oxford and St. Hilda's College, Oxford, England, Academic Press, 1986, pp. 213-216.

(Continued)

*Primary Examiner* — Frantz F Jules
*Assistant Examiner* — Devon Moore
(74) *Attorney, Agent, or Firm* — Justin K. Murray

(57) ABSTRACT

A heat exchanger for indirect heat exchange between a first and a second fluids to be cooled and at least a third fluid to be heated, made up of a plurality of passages, namely a first series of passages for the flow at least of the first and of the second fluids, a second series of passages for the flow of the third fluid to be placed in a heat exchange relationship with the first and second fluids, the exchanger comprising three sections, the second section being between the first and third (Continued)

sections and means for introducing the first fluid into only a portion of the passages of the first series in the second section.

10 Claims, 11 Drawing Sheets

(58) Field of Classification Search
CPC .. F25J 3/04472; F25J 3/04224; F25J 3/04236; F25J 2290/40; F25J 2290/32; F28D 9/0093; F28D 9/0068; F28D 2021/0033; F28F 2250/108
USPC ..... 165/140, 166
See application file for complete search history.

(56) References Cited

U.S. PATENT DOCUMENTS 4,721,164 A * 1/1988 Woodward ..... F25J 3/0209 166/267
5,787,975 A * 8/1998 Grenier ..... F25J 3/04375 62/903
6,044,902 A 4/2000 Pahade et al.
6,128,920 A * 10/2000 Matsuo ..... F28D 9/0068 62/903
6,347,662 B1 * 2/2002 Davidian ..... F25J 3/04412 165/146
7,779,899 B2 * 8/2010 Jibb ..... F25J 3/044 165/166
2017/0045291 A1 2/2017 Cardon et al.
2022/0268528 A1 8/2022 Haik-Beraud et al.

FOREIGN PATENT DOCUMENTS

FR 2 844 040 3/2004
WO WO 2015/166191 11/2015
WO WO 2021/019160 2/2021

OTHER PUBLICATIONS

French Search Report for FR 2 200 107, mailed Aug. 2, 2022.

* cited by examiner

[FIG.1]
(Prior Art)
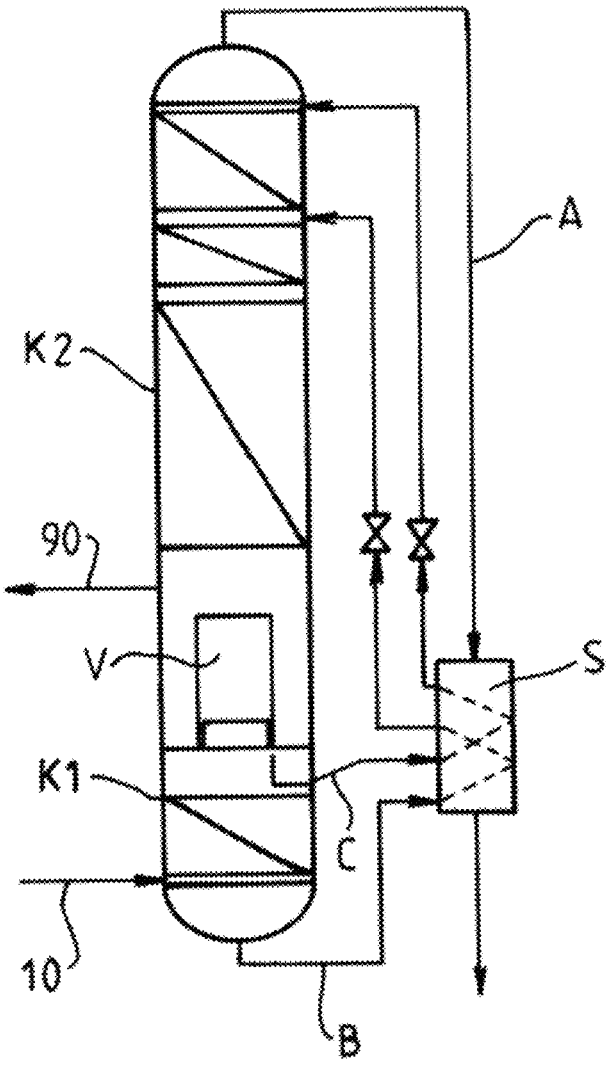

[FIG.2A]
(Prior Art)
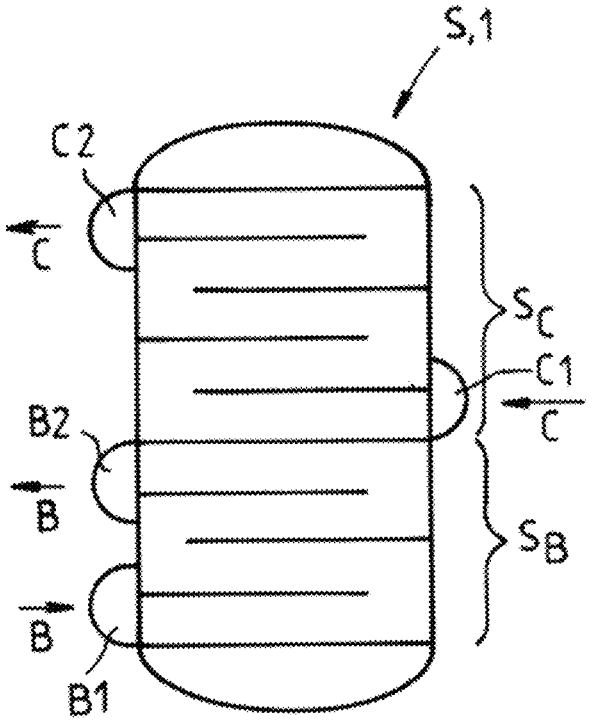

[FIG.2B]
(Prior Art)
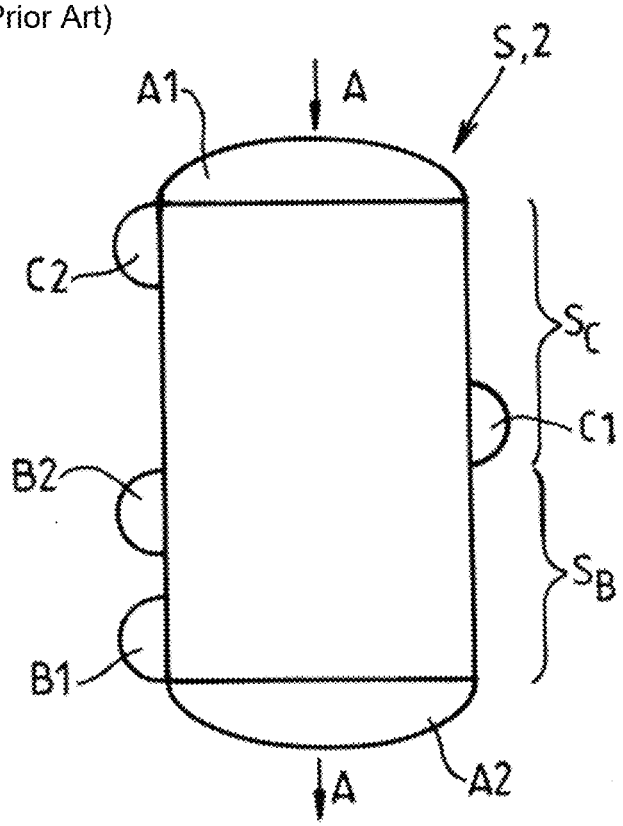

[FIG.3A]
(Prior Art)
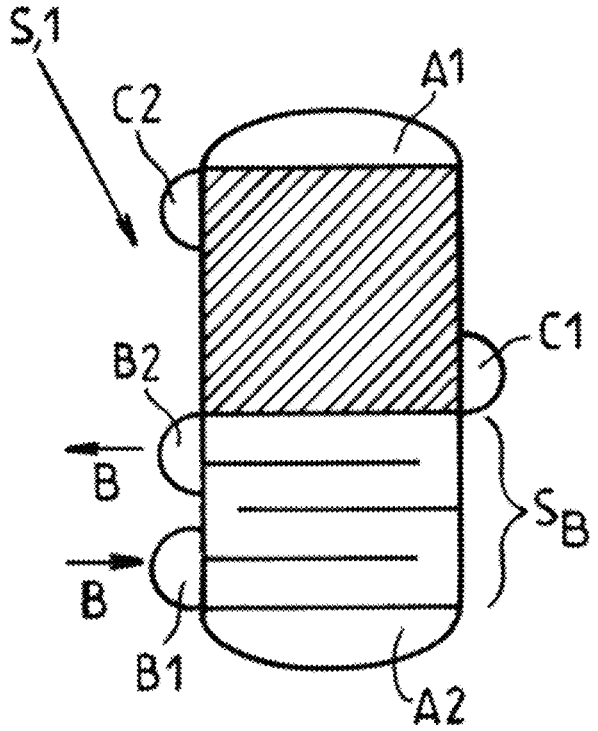

[FIG.3B]
(Prior Art)
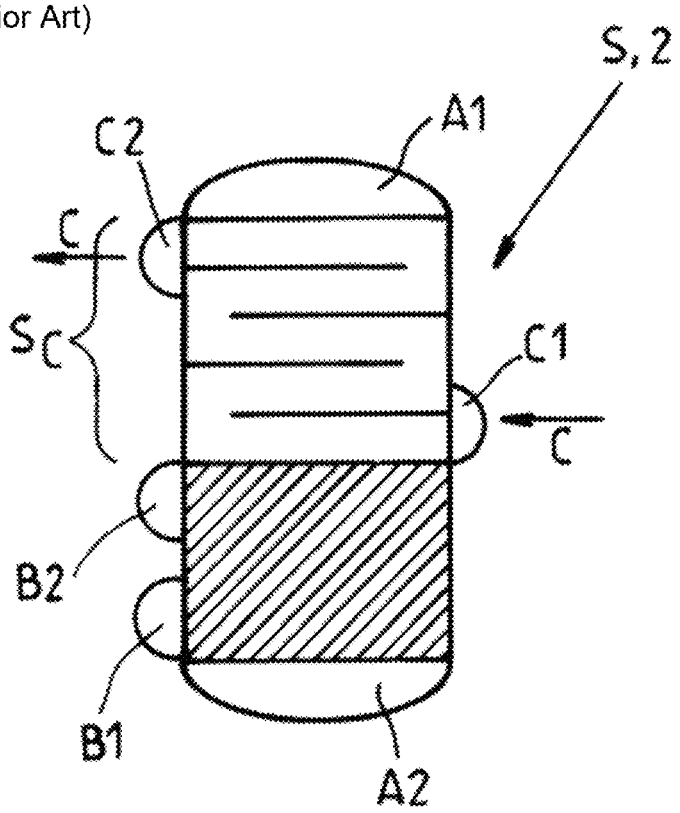

[FIG.3C]
(Prior Art)
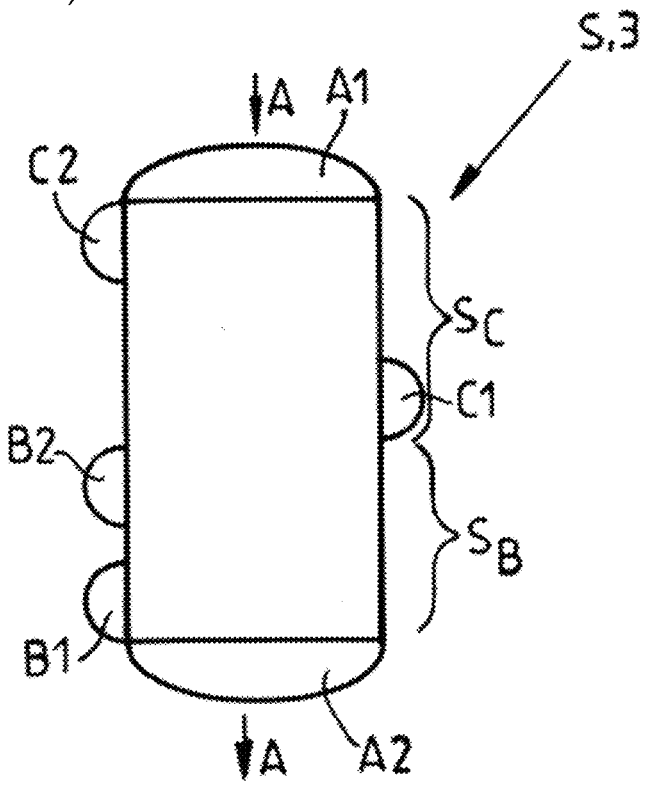

[FIG.4A]
(Prior Art)
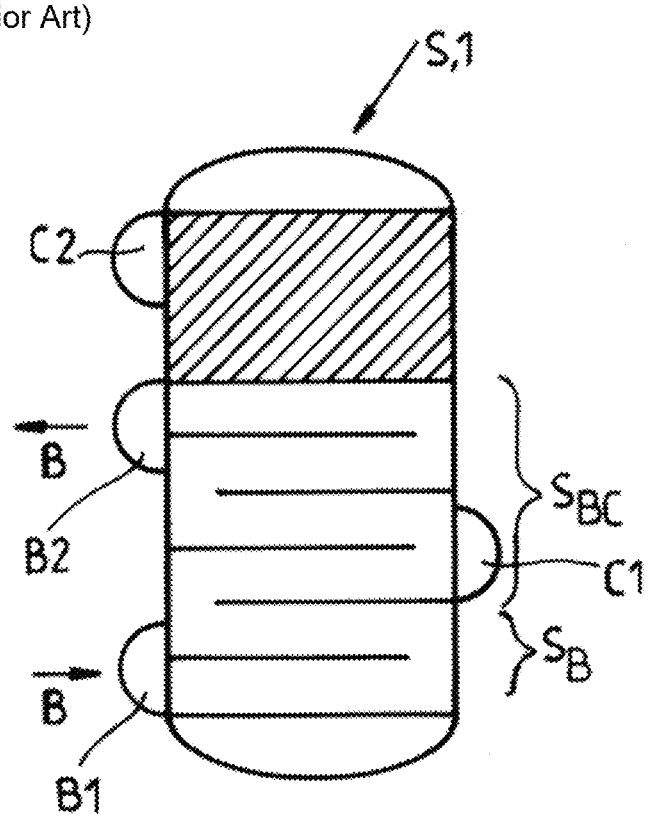
[FIG.4B]
(Prior Art)
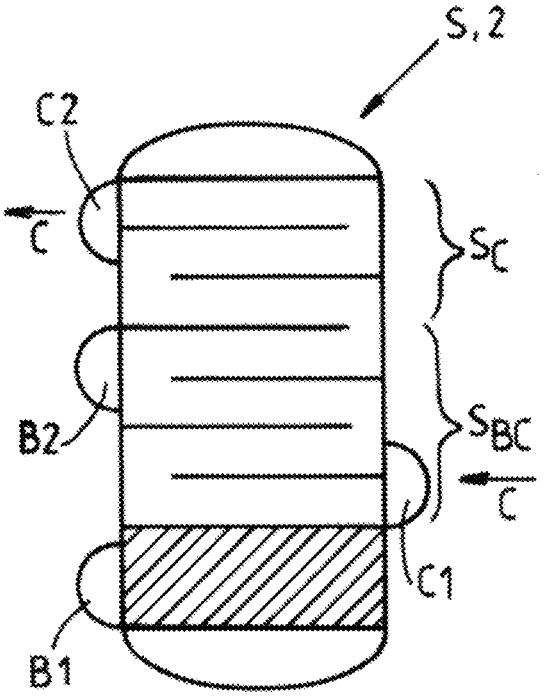

[FIG.4C]
(Prior Art)
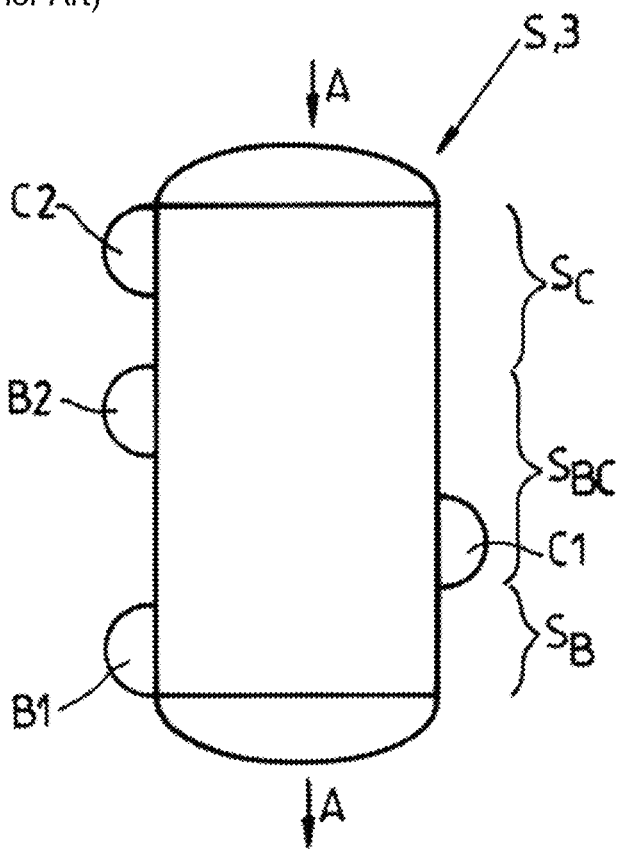

[FIG.5A]
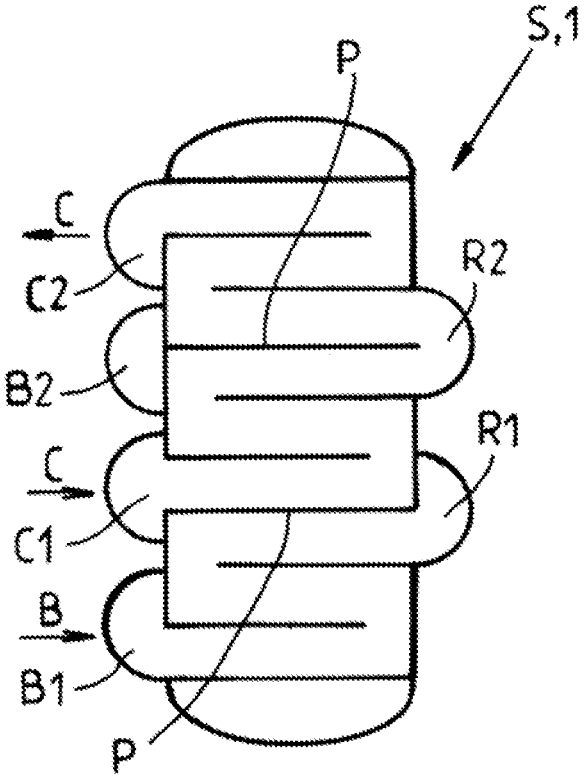

[FIG.5B]
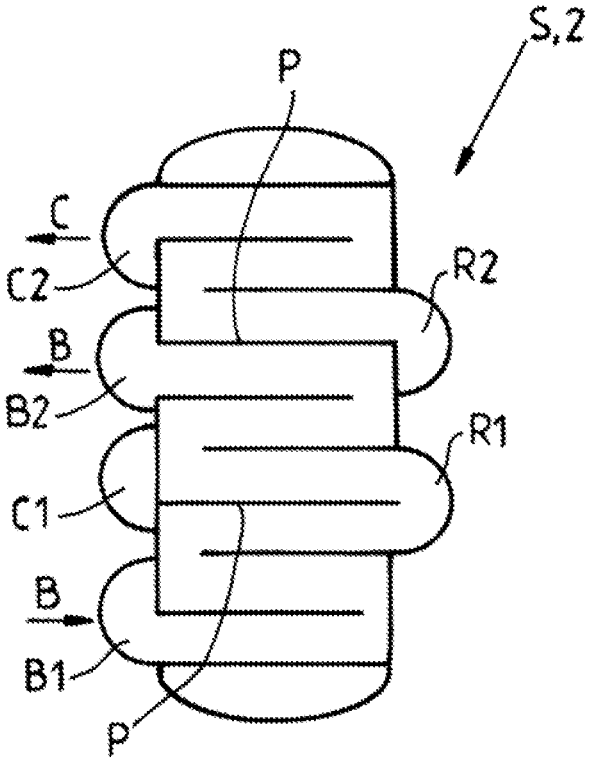

[FIG.5C]
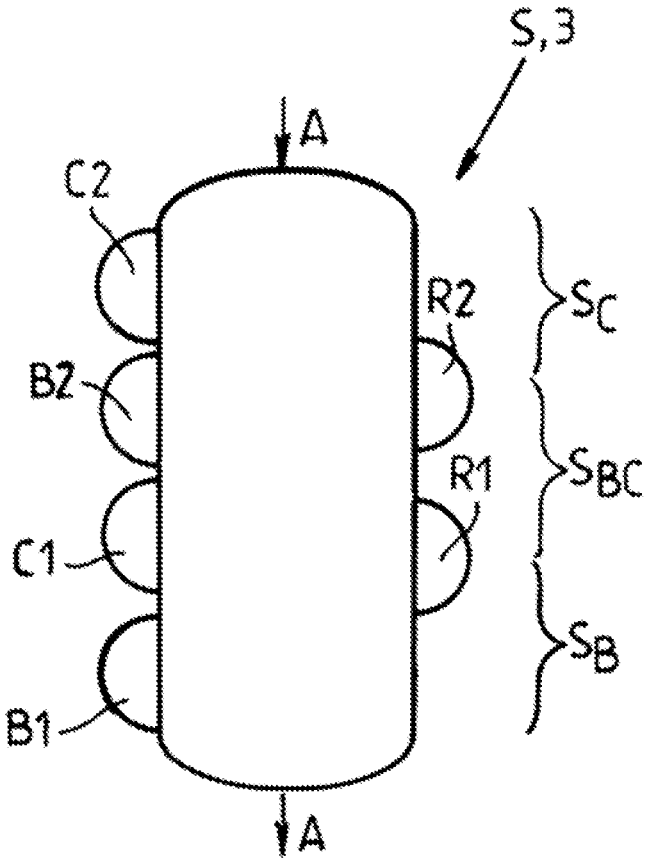

HEAT EXCHANGER AND SEPARATION APPARATUS COMPRISING A HEAT EXCHANGER

CROSS REFERENCE TO RELATED APPLICATIONS

This application claims the benefit of priority under 35 U.S.C. § 119 (a) and (b) to French patent application No. FR2200107, filed Jan. 7, 2022, the entire contents of which are incorporated herein by reference.

FIELD OF THE INVENTION

The present invention relates to a heat exchanger and to a separation apparatus comprising a heat exchanger. The heat exchanger may be of cross-current type, but it may also apply to a counter-current exchanger, as described for supercoolers in "Cryogenic Engineering" edited by B. A. Hands, Academic Press, 1986, pages 213-216, EP1338856 and DE102018009780.

BACKGROUND OF THE INVENTION

FIG. 1 shows a separation apparatus comprising a first column K1 operating at a first pressure and a second column K2 adapted to operate at a second pressure below the first pressure, the head of the first column being thermally linked to the tank of the second column, and means for sending purified and cooled air 10 to at least the first column.

To create reflux in the second column, liquid B from the tank of the first column, rich in oxygen, is sent to an intermediate stage of the second column after supercooling and expansion.

Likewise, liquid C from the head of the first column, rich in nitrogen, is sent to the head of the second column after supercooling often in the same supercooler S as the liquid rich in oxygen, then expanded. These two liquids are referred to as rich liquid and poor liquid, respectively.

The liquids are cooled by heat exchange with a gaseous nitrogen flow A of the second column which is heated in the supercooler.

In a supercooler of an apparatus for separating air by cryogenic distillation, in particular in a cross-current configuration, the cooling of the poor liquid and of the rich liquid takes place in two exchangers in series, as in U.S. Pat. No. 2,840,994. These exchangers may be integrated in a single exchanger with separate sections. This means that the rich liquid is cooled to a temperature above the entry temperature of the poor liquid. The invention consists in making it possible to boost the cooling of the rich liquid without creating a dead passage in the exchanger, with a saving in terms of compactness.

The rich liquid B coming from the tank of the first column K1 leaves the supercooler S at a temperature which is cooler than the entry temperature of the poor liquid C coming from the head of the column K1.

Liquid or gaseous oxygen 90 is withdrawn at the bottom of the column K2 as product.

FIG. 2A and FIG. 2B show passages making up a prior art heat exchanger with separate sections for cooling the liquids B, C.

FIG. 2A shows one of the passages 1 of the series of n passages in which:

liquid B enters a first section $S_B$ of the exchanger S according to the prior art via a box B1 and leaves via a box B2.

liquid C enters a second section $S_C$ of the exchanger S according to the prior art via a box C1 and leaves via a box C2.

The two sections $S_B$ and $S_C$ are in series.

FIG. 2B shows one of the passages 2 of the series of n+1 or 2n passages specifically for the gas A which runs the whole length of the exchanger S according to the prior art, in order to heat the passages of FIG. 2A which are on either side of the passages of FIG. 2B. The gas descends, starting from the inlet A1, and is heated in a dedicated series of passages before arriving at the outlet A2. Thus, in the first section the gas A only exchanges heat with the liquid B and in the second section the gas A only exchanges heat with the liquid C.

The exchanger S is composed of a stack of passages combining the two series of passages, with a pattern typically as follows: (21)*n'2 or (212)*n', n' being the number of repetitions of the pattern, greater than or equal to 1.

FIG. 3A and FIG. 3B show passages making up a prior art heat exchanger with separate sections for cooling the liquids B, C.

FIG. 3A shows one of the passages 1 of the series of n passages specifically for the liquid B entering a first section $S_B$ of the exchanger S via a box B1 and leaving via a box B2. The hatched area represents a dead zone where no heat exchange takes place since no fluid is circulating therein.

FIG. 3B shows one of the passages 2 of the series of p passages specifically for the liquid C entering a second section $S_B$ of the exchanger S via a box C1 and leaving via a box C2. The hatched area represents a dead zone where no heat exchange takes place since no fluid is circulating therein.

FIG. 3C shows one of the passages 3 of the series of n+p+1 or 2n+2p passages specifically for the gas A which runs the whole length of the exchanger S in order to heat the passages of FIG. 3A and FIG. 3B which are on either side of the passages of FIG. 3C. The gas descends, starting from the inlet A1, and is heated in a dedicated series of passages before arriving at the outlet A2. Thus, in the first section the gas A only exchanges heat with the liquid B and in the second section the gas A only exchanges heat with the liquid C.

The exchanger S is composed of a stack of passages combining the three series of passages of FIG. 3A, FIG. 3B and FIG. 3C with a pattern typically as follows when n=p: (3132)*n'3 or (313323)*n', n' being the number of repetitions of the pattern, greater than or equal to 1.

FIG. 4A, FIG. 4B and FIG. 4C show a variant of FIG. 3A, FIG. 3B and FIG. 3C in which the liquid B leaves the exchanger at a temperature which is cooler than the temperature at which the liquid C enters the exchanger. Thus, there is a central section $S_{BC}$ of the exchanger where the gas A exchanges heat simultaneously with the two liquids B, C.

SUMMARY OF THE INVENTION

According to subject matter of the invention, there is provided a heat exchanger for indirect heat exchange between a first and a second fluids to be cooled and at least a third fluid to be heated, the exchanger being made up of a stack of spaced-apart rectangular plates, the stack having a length, a width and a height, the plates having a length and a width that are respectively the length and the width of the stack, the plates being parallel to one another in such a way as to define between said plates a plurality of passages, namely a first series of passages for the flow at least of the first and of the second fluids, a second series of passages for the flow of the third fluid to be placed in a heat exchange relationship with the first and second fluids, said passages being delimited by peripheral edges, the exchanger comprising three sections, each defined by the height and the width of the stack and a fraction of the length of the stack, the three sections comprising a first section comprising an end of the stack, a second section, and a third section comprising the other end of the stack, the second section being between the first and third sections and at least two of the first, second and third sections being juxtaposed, means closing off the first series of passages where the first and the second section are juxtaposed and/or where the second and the third section are juxtaposed, means for introducing the first fluid into the passages of the first series at a free end of the first section, means for bringing the first fluid out of the passages of the first series of the first section, means for introducing the first fluid into only a portion of the passages of the first series in the second section, means for bringing the first fluid out of the portion of the passages of the first series, means for introducing the second fluid into another portion, or indeed the rest of the passages of the first series in the second section, means for bringing the second fluid out of the other portion, or indeed out of the rest of the passages of the first series of the second section, means for introducing the second fluid into the passages of the first series in the third section, means for bringing the second fluid out of the passages of the first series at the free end of the third section, means for introducing the third fluid into the third section, means for causing the third fluid to pass through the third, second and first sections successively and means for withdrawing the third fluid from the first section.

According to other, optional aspects:

- n passages of the first series are specifically for the first fluid in the first section and n-m passages of the first series are specifically for the first fluid in the second section.
- no passage is connected for the flow of the first fluid in the third section.
- n passages of the first series are specifically for the second fluid in the third section and q where q<=m passages of the first series are specifically for the second fluid in the second section.
- q≠n
- n passages of the first series are specifically for the second fluid in the third section and m where m<n passages of the first series are specifically for the second fluid in the second section.
- no passage is connected for the flow of the second fluid in the first section.
- the number of passages of the first series specifically for the first fluid in the first section is n and the number of passages of the first series specifically for the first fluid in the second section is n/2.
- the number of passages specifically for the second fluid in the second section is n/2 and the number of passages specifically for the second fluid in the third section is n.
- the exchanger is adapted to cool only two fluids
- the plates are made of aluminium and are separated from one another by fins forming channels in the passages, the plates and the fins being brazed together.
- the exchanger comprises only the first and second series of passages.
- the exchanger comprises a third series of passages for heating a fourth fluid
- the first series of passages comprises at least a first passage formed between two successive plates and at least a second passage formed between two successive plates, each of which is adjacent to a passage of the second series.

According to further subject matter of the invention, there is provided an air separation apparatus comprising a first column adapted to operate at a first pressure and a second column adapted to operate at a second pressure below the first pressure, the head of the first column being thermally linked to the tank of the second column, means for sending purified and cooled air to at least the first column, means for sending a first fluid, which is a liquid, from the tank of the first column to the second column, means for sending a second fluid, which is a liquid, from the head of the first column to the second column, means for withdrawing a third fluid, which is a gas rich in nitrogen, from the second column, means for withdrawing a fluid rich in oxygen from the second column and a heat exchanger as described above connected to the means for sending the first fluid from the tank of the first column to the second column, to the means for sending the second fluid from the head of the first column to the second column and to the means for withdrawing the third fluid from the second column so as to allow heating at least of the third fluid by indirect heat exchange with at least the first and second fluids which are cooled.

The invention consists, in a central area of the exchanger where the rich liquid and the poor liquid coexist, in superposing the two fluids in the exchanger, attributing a portion of the passages to one fluid and at least a portion of the other passages to the other fluid, for example by dividing by 2 the numbers of passages for each fluid, with an external redistribution box making it possible to go from the n passages to n/2 in this central area.

This avoids dead zones in the exchanger, with an increase in efficiency and compactness.

The invention applies to a cross-current exchanger, but may also apply to a counter-current exchanger.

Note that the exchanger may also be used to heat a third liquid.

BRIEF DESCRIPTION OF THE DRAWINGS

Further features and advantages of the invention will become apparent from the description hereinafter of embodiments, which are given by way of illustration but without any limitation, the description being given in relation with the following attached figures:

FIG. 1 shows a typical separation system of the prior art.

FIG. 2A shows a cross sectional view of a heat exchanger of the prior art.

FIG. 2B shows another view of a heat exchanger of the prior art.

FIG. 3A shows a cross sectional view of a heat exchanger of the prior art.

FIG. 3B shows a cross sectional view of an alternative configuration of a heat exchanger of the prior art.

FIG. 3C shows one of the passages of a heat exchanger of the prior art.

FIG. 4A shows a prior art variant of the heat exchanger of FIG. 3A.

FIG. 4B shows a prior art variant of the heat exchanger of FIG. 3B.

FIG. 4C shows a prior art variant of the heat exchanger of FIG. 3C.

FIG. 5A shows one of the passages 1 of the first series of passages specifically for cooling liquids in the exchanger in accordance with an embodiment of the present invention.

FIG. 5B shows another of the passages 2 of the first series of passages specifically for cooling liquids in the exchanger in accordance with an embodiment of the present invention.

FIG. 5C shows one of the passages 3 of the second series of passages specifically for heating a gas in the exchanger in accordance with an embodiment of the present invention.

DETAILED DESCRIPTION OF THE INVENTION

A heat exchanger according to the invention is made up of a stack of spaced-apart rectangular plates, the stack having a length, a width and a height, the plates having a length and a width that are respectively the length and the width of the stack, the plates being parallel to one another in such a way as to define between said plates a plurality of passages.

The passages comprise a first series of passages for the flow of the first and second fluids and a second series of passages for the flow of a third fluid to be placed in a heat exchange relationship with the first and second fluids.

In the case described, the exchanger only comprises the first and the second series. However, in other cases, more than two liquids may be cooled.

The first series of passages comprises at least a first passage 1 formed between two successive plates and at least another second passage 2 formed between two successive plates, each of which is adjacent to a passage of the second series.

The passages are delimited by peripheral edges.

The exchanger comprises three sections, each defined by the height and the width of the stack and a fraction of the length of the stack, the three sections comprising a first section comprising an end of the stack, a second section, and a third section comprising the other end of the stack, the second section being between the first and third sections and the first, second and third sections being juxtaposed in this example.

In the sections at the ends of the exchanger, all of the passages of the first series preferably receive a single liquid to be cooled. In at least a central section, only a portion of the passages of the first series are supplied with the liquid B, others, or indeed the rest, being supplied with the liquid C.

FIG. 5A shows one of the passages 1 of the first series of passages of the heat exchanger where the liquids B and C are cooled, while FIG. 5B shows another of the passages 2 of the first series of passages of the heat exchanger where the liquids B and C are cooled. Each of these passages is in contact with a passage 3 for heating a gas A according to FIG. 5C.

Each series of passages includes a first section $S_B$, a second section $S_{BC}$ and a third section $S_C$. The subscript reference indicates the liquid that is cooled in the section: thus, only the liquid B is cooled in the first section $S_B$, the two liquids B, C are cooled in the second section $S_{BC}$ and only the liquid C is cooled in the third section $S_C$.

Looking at FIG. 5A and FIG. 5B, the liquid B enters the exchanger at the lower end constituting the hot end in the passages of each of the figures in the first section $S_B$. The inlet box B1 communicates with the set of passages and other passages 1 and 2 allowing circulation essentially in a direction perpendicular to the axis of the exchanger. The partially supercooled liquid B leaves a first section $S_B$ via a box R1 which does not allow the liquid B to circulate through the passages 1 of FIG. 5A but sends it to the other passages 2 of FIG. 5B where it circulates in a portion of the set of passages, in this case half, of the second section $S_{BC}$. Next, the liquid B leaves the exchanger via the box B2 of the other passages 2 of FIG. 5B and does not pass through the passages of the third section $S_C$.

Likewise, the liquid C directly enters the second section $S_{BC}$ without passing through the first section $S_B$. The liquid C is cooled only in the other passages 2 of FIG. 5A and not in the passages 1 of FIG. 5B in the second section $S_{BC}$. Next, the box R2 distributes the partially cooled liquid C over the set of passages and other passages 1 and 2 FIG. 5A and FIG. 5B, so that it leaves the box C2 fully cooled.

The gas A passes through the exchanger successively through the third, second and first sections and is withdrawn heated from the first section.

The three sections thus comprise a first section comprising an end of the stack, a second section, and a third section comprising the other end of the stack, the second section being between the first and third sections. Each of the three sections is defined by the height and the width of the stack and a fraction of the length of the stack.

The invention is described here with the same number of passages in the second section for the liquids B, C, for example rich liquid and poor liquid, of an air separation apparatus. It may be extrapolated with different numbers of passages and different or additional fluids.

The exchanger includes a first series of passages composed of the passages 1 and other passages 2 of FIG. 5A and FIG. 5B, and a second series of passages composed of the passages 3 of FIG. 5C.

The exchanger S is composed of a stack of passages combining the two series of passages, with a pattern typically as follows: (3132)*n'3 or (313323)*n', n' being the number of repetitions of the pattern, greater than or equal to 1.

In the configuration of the exchanger, there is no dead zone without heat exchange.

The exchanger is "cut up" into 3 sections:

A section $S_B$ with only the rich liquid B circulating

A shared section $S_{BC}$ where the rich liquid B and the poor liquid C coexist

A section $S_C$ with only the poor liquid C circulating.

In the specific example of separation of air, the rich liquid B enters, at the bottom, n passages in the section $S_B$, then leaves via an external box, before again entering a portion, for example n/2 passages at the bottom of the shared section $S_{BC}$, so as to then leave at the top of the shared area.

The poor liquid C enters a portion, or indeed the rest of the passages, for example n/2 passages at the bottom of the shared section $S_{BC}$, then leaves via an external box at the top of the shared section, and again enters n passages at the bottom of the section $S_C$, so as to then leave at the top of the section $S_C$.

The external boxes R1, R2 make it possible to change the number of passages in which the fluid circulates around the exchanger.

The inlets/outlets B1, B2, C1, C2 may be on the same face or on opposite faces, depending on the number of passes.

The principle may be extended to a different number of passages between rich liquid and poor liquid, and the distribution in the shared area may be other than half/half.

There may also be fluids other than a rich liquid and a poor liquid, typically liquid air, liquid nitrogen and liquid oxygen. Likewise, there may be pure nitrogen in addition to residual nitrogen.

The exchanger comprises walls P closing off the first series of passages where the first and the second sections are juxtaposed and/or where the second and the third sections are juxtaposed.

Preferably, the plates of the exchanger are made of aluminium and are separated from one another by fins forming channels in the passages, the plates and the fins being brazed together.

The exchanger according to the invention may be of cross-current type, but it may also apply to a counter-current exchanger.

The exchanger may be integrated in an air separation apparatus comprising a first column adapted to operate at a first pressure and a second column adapted to operate at a second pressure below the first pressure, the head of the first column being thermally linked to the tank of the second column, means for sending purified and cooled air to at least the first column, means for sending a first fluid B, which is a liquid, from the tank of the first column to the second column, means for sending a second fluid C, which is a liquid, from the head of the first column to the second column, means for withdrawing a third fluid A, which is a gas rich in nitrogen, from the second column, means for withdrawing a fluid rich in oxygen from the second column. The heat exchanger is connected so as to allow heating of the third fluid by indirect heat exchange with the first and second fluids, preferably with its main axis vertical.

The heat exchanger may be used to heat at least two fluids, for example two gaseous nitrogen flows, by adding at least one additional series of heating passages or by splitting the passages of the second series.

The heat exchanger may be used to cool at least three fluids by splitting the passages of the second section into at least three.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

The invention claimed is:

1. A heat exchanger for indirect heat exchange between a first fluid and a second fluid to be cooled and at least a third fluid to be heated, the heat exchanger comprising:

a stack of spaced-apart rectangular plates, the stack having a length, a width and a height, the plates having a length and a width that are respectively the length and the width of the stack, the plates being parallel to one another in such a way as to define between said plates a plurality of passages, the plurality of passages comprising a first series of said passages for the flow of the first and of the second fluids, a second series of said passages for the flow of the third fluid, wherein the first series of said passages are in a heat exchange relationship with the second series of said passages such that the first and second fluids exchange heat with the third fluid, said passages being delimited by peripheral edges;

three sections, each defined by the height and the width of the stack and a fraction of the length of the stack, the three sections comprising a first section comprising a first end of the stack, a second section, and a third section comprising a second end of the stack, the second section being between the first and third sections and at least two of the first, second and third sections being juxtaposed;

a first wall configured to close off the first series of said passages where the first and the second section are juxtaposed and a second wall configured to close off where the second and the third section are juxtaposed;

a first fluid inlet configured to receive the first fluid into the passages of the first series at a free end of the first section;

a first fluid return outlet configured to bring the first fluid out of the passages of the first series of the first section;

a first fluid return inlet in fluid communication with the first fluid return outlet, wherein the first fluid return inlet is configured to introduce the first fluid into a first fluid portion of the passages of the first series in the second section;

a first fluid outlet configured to bring the first fluid out of the first fluid portion of the passages of the first series in the second section;

a second fluid inlet configured to receive the second fluid into a second fluid portion of the first series in the second section;

a second fluid outlet configured to withdraw the second fluid out of the passages of the first series at a free end of the third section, wherein the second fluid outlet is in fluid communication with the second fluid inlet, such that the heat exchanger is configured to allow the second fluid to travel from the second fluid inlet through the second fluid portion of the first series in the second section to the passages of the first series in the third section and finally to the second fluid outlet;

a third fluid inlet configured to receive the third fluid into the third section; and a third fluid outlet configured to withdraw the third fluid from the first section, wherein the third fluid inlet and the third fluid outlet are in fluid communication, such that the third fluid travels from the third fluid inlet, through the third section, the second section and the first section in succession, prior to reaching the third fluid outlet.

2. The heat exchanger according to claim 1, wherein n passages of the first series are specifically for the first fluid in the first section and n-m passages of the first series are specifically for the first fluid in the second section, wherein m passages are the number of passages in the first series allocated to the second fluid within the second section.

3. The heat exchanger according to claim 1, wherein no passage is connected for the flow of the first fluid in the third section.

4. The heat exchanger according to claim 1, wherein n passages of the first series are specifically for the second fluid in the third section and m where m<n passages of the first series are specifically for the second fluid in the second section.

5. The heat exchanger according to claim 1, wherein no passage is connected for the flow of the second fluid in the first section.

6. The heat exchanger according to claim 1, wherein the number of passages of the first series specifically for the first fluid in the first section is n and the number of passages of the first series specifically for the first fluid in the second section is n/2.

7. The heat exchanger according to claim 1, wherein the number of passages specifically for the second fluid in the second section is n/2 and the number of passages specifically for the second fluid in the third section is n.

8. The heat exchanger according to claim 1, wherein the plates are made of aluminium and are separated from one another by fins forming channels in the passages, the plates and the fins being brazed together.

9. The heat exchanger according to claim 1, further comprising only the first and second series of said passages.

10. An air separation apparatus comprising:

a first column configured to operate at a first pressure and a second column configured to operate at a second pressure below the first pressure;

a head of the first column being thermally linked to a tank of the second column;

an air inlet configured to receive a purified and cooled air stream to the first column, the heat exchanger according to claim 1;

a withdrawal line configured to withdraw a nitrogen gas stream from a head of the second column and introduce the nitrogen gas stream into a cold end of the heat exchanger, wherein a tank of the first column is in fluid communication with the second column and the heat exchanger, such that the second column is configured to receive a crude liquid oxygen stream from the tank of the first column after the crude liquid oxygen has been cooled within the heat exchanger, wherein the head of the first column is in fluid communication with the second column and the heat exchanger, such that the second column is configured to receive a crude liquid nitrogen stream from the head of the first column after the crude liquid nitrogen has been cooled within the heat exchanger.

* * * * *